US005265504A

United States Patent [19]

Fruhm

[11] Patent Number: 5,265,504

[45] Date of Patent: Nov. 30, 1993

[54] CARTRIDGE TYPE SCREWDRIVER

[76] Inventor: Hermann Fruhm, 210 Tenth Avenue, New Westminster, British Columbia, Canada, V3L 2B2

[21] Appl. No.: 983,972

[22] Filed: Dec. 1, 1992

[51] Int. Cl.[5] ..... B25B 23/00

[52] U.S. Cl. ..... 81/439; 81/177.4; 81/490

[58] Field of Search ..... 81/437–440, 81/177.4, 490

[56] References Cited

U.S. PATENT DOCUMENTS 3,753,455 8/1973 Butler ..... 145/63
4,463,788 8/1984 Corona et al. ..... 145/63
4,572,038 2/1986 Graham ..... 81/439

*Primary Examiner*—D. S. Meislin
*Attorney, Agent, or Firm*—Barrigar & Oyen

[57] ABSTRACT

A multiple bit screwdriver employs a breach loading magazine to store a plurality of bits. The magazine is enclosed inside the hollow handle of the screwdriver and is extracted along the axis of the screwdriver when the end-cap of the handle is pulled. The bits are stored in the magazine and are located about the circumference of the magazine tube that reciprocates relative to the screwdriver. When the magazine is fully extracted, the bits are easily viewed and may be individually removed from or replaced in the clips applying a simple radial force.

7 Claims, 5 Drawing Sheets

VIIIA
11
50
10
12
IC
IVB
VIIIA
13
IVB
IC

15
IIB
IIB
11
14
IID
IID
IIC
17
16
IIC

14

17
16

13
IVA
IVA

CARTRIDGE TYPE SCREWDRIVER

This invention relates to a multiple bit tool, and, more particularly, to a multiple bit tool such as a screwdriver.

BACKGROUND OF THE INVENTION

The use and existence of multiple bit tools are well known. Generally and in the case of a screwdriver used manually, the bits are stored in the handle of the screwdriver. To retrieve a bit, the user removes the end-cap of the handle to expose the bits. One difficulty with such tools is that users have difficulty determining the appropriate bit without its removal. Hence, all of the bits are usually emptied from the handle.

Various mechanisms have been devised to select individual bits. In U.S. Pat. No. 4,463,788 to Corona et al, a mechanism includes a rotatable disk at the anterior end of the handle in which a slot acts to guide one bit at a time from the storage chamber, or magazine, into the chuck.

In U.S. Pat. No. 4,572,038 to Graham, a mechanism is described in which the bits are stored in a forward magazine which rotates about a rear retractable driving shaft in order to individually engage the bits stored in the magazine.

In U.S. Pat. No. 3,753,455 to Butler, the bits can be gravity fed from the storage chamber directly into the chuck.

SUMMARY OF THE INVENTION

According to the invention, there is provided a screwdriver type tool comprising a chuck, a first stationary shaft extending from said chuck and within a handle, a second barrel shaft longitudinally movable on said first stationary shaft from a first position wherein said second barrel shaft is substantially wholly within said handle to a second position wherein said second barrel shaft is substantially outside said handle.

DESCRIPTION OF THE SPECIFIC EMBODIMENT

With reference now to the drawings, a tool, conveniently a screwdriver is generally illustrated at 10 in FIG. 1. It comprises a first stationary shaft 11, an injection moulded hollow handle 12 which surrounds the circumference of one end of first stationary shaft 11, and an end-cap 13 which forms an enclosure with hollow handle 12 and is movable relative to the handle 12 as will be explained.

Figures 1A, 1B, 1C, 2A, 2B, 2C, 2D:
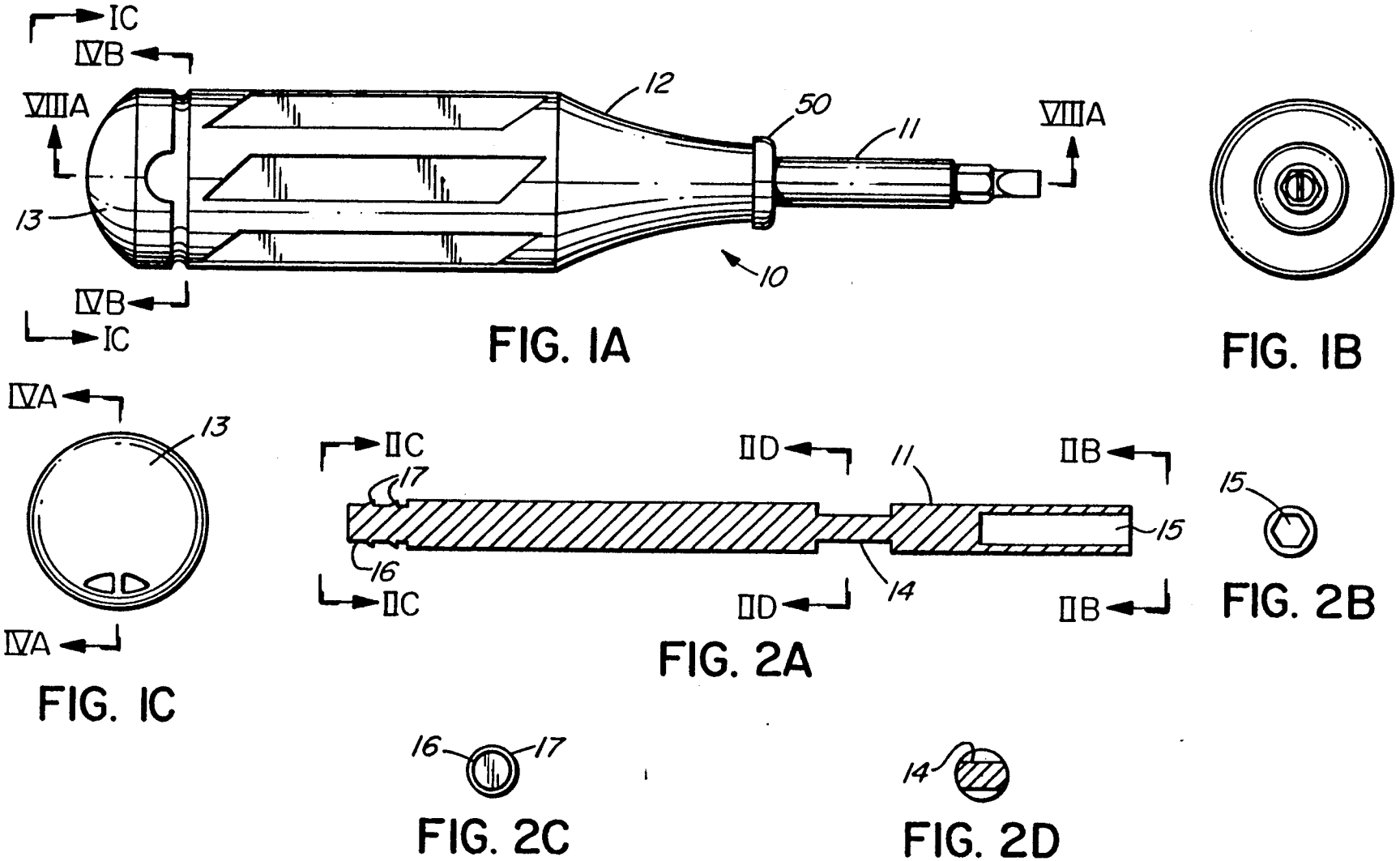
FIGS. 1A, 1B and 1C are side, front and end views, respectively, of a screwdriver according to one aspect of the present invention.
FIGS. 2A, 2B and 2C are side, front and end views, respectively of a first stationary shaft used in the tool.
FIG. 2D is a view taken along IID—IID of FIG. 2A.
Figure 3B:
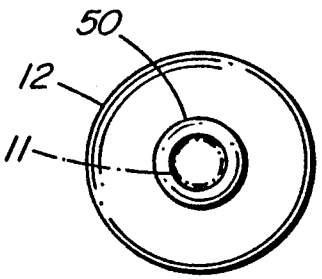
FIGS. 3A and 3B are side and end views of the handle of the tool of FIG. 1 together with the shaft of FIG. 2.

With reference now to FIG. 2A, the first stationary shaft 11 includes a flat portion 14 with which the injection moulded handle 12 makes contact. The first stationary shaft 11 also includes a hexagonal opening or chuck 15 operable to accept a tool bit. The opposite end of first stationary shaft 11 to the chuck 15 exhibits a reduced diameter 16 and includes a plurality of circumferential teeth 17.

Figure 5B:
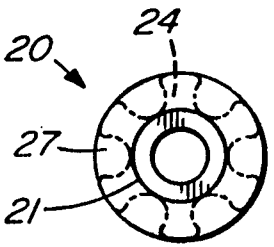
FIG. 5B a view taken along VB—VB of FIG. 5A.
Figure 3A:
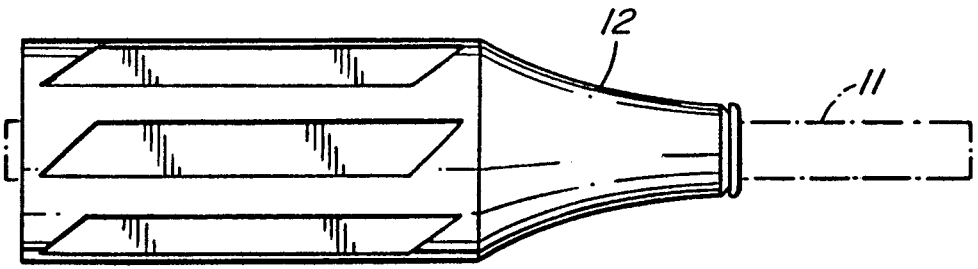
Figure 5A:
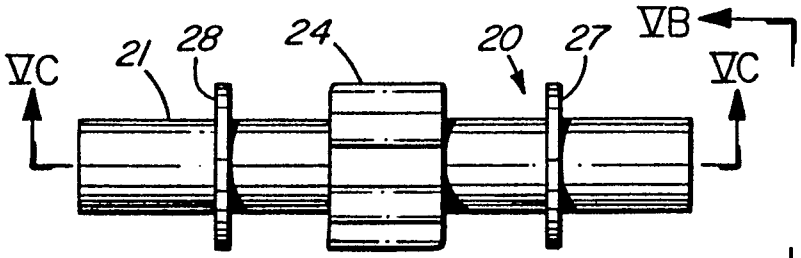
FIGS. 5A is a side view of the bit magazine and barrel shaft of the tool according to the invention.
Figure 5C:
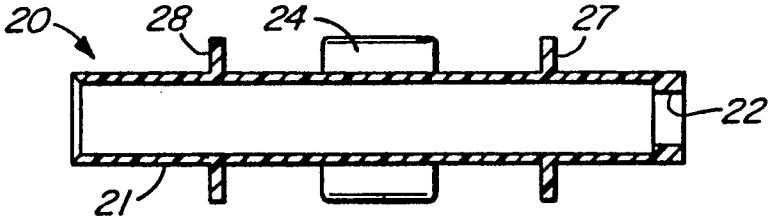
FIG. 5C is a cross-sectional view taken along VC—VC of FIG. 5A.

A bit storage magazine generally illustrated at 20 (FIG. 5C) includes a second barrel shaft 21 with a plurality of outwardly extending fins 24 about its circumference, each pair of fins being operable to accept and retain a tool bit having a circumference of a size to fit in chuck 15. Second barrel shaft 21 includes a section having a narrower internal diameter or collar 22 and a concave bevel 23 at the opposite end. The internal diameter 22 is only slightly larger than the outer diameter of the first stationary shaft 11 such that second barrel shaft 21 may be reciprocated along first stationary shaft 11.

A retaining ring generally illustrated at 30 (FIG. 6) is in the form of a cylinder 31 with an opening 32 operable to accept the end of first stationary shaft 11 and teeth 17, and a circular spring type clip 33 having a plurality of arms 35 which is operable to be inserted into and produce friction against the second barrel shaft 21 and to temporarily lock into bevel 23 in second barrel shaft 21 as the flexible arms 35 expand after passing over bevel 23.

Figure 4B:
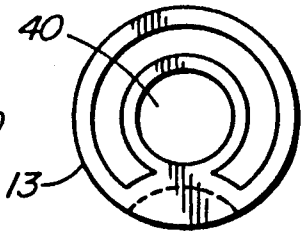
FIGS. 4A and 4B are views of the cap taken along 4A and 4B of FIG. 1.
Figure 4A:
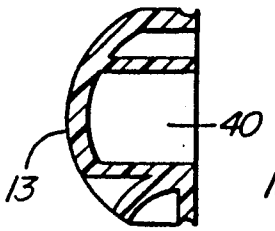
Figure 6A:
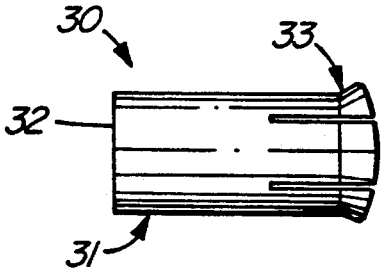
FIGS. 6A, 6B , 6C are side, right end and left end views of the retaining ring of the tool according to the invention.
Figure 6B:
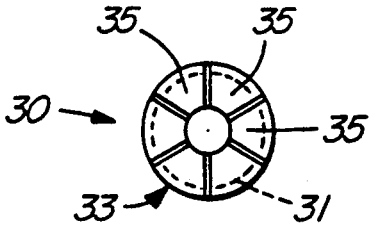
Figure 6C:
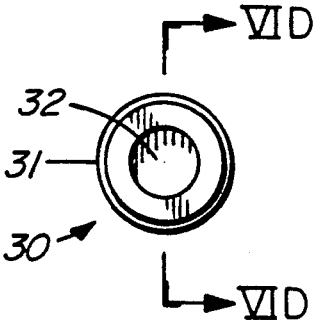
Figure 6D:
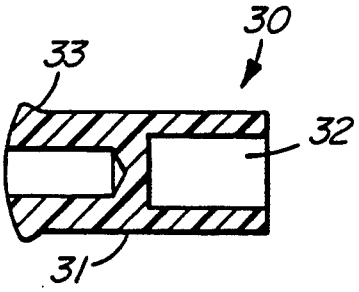
FIG. 6D is a cross-sectional view taken along VID—VID of FIG. 6C.
Figure 7A:
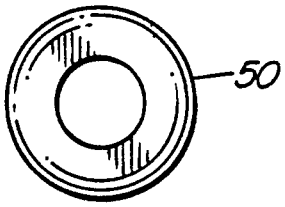
FIGS. 7A and 7B are side and end views of the handle bearing of the tool according to the invention.
Figure 7B:
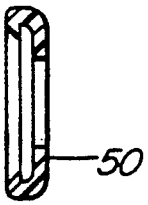
Figure 8A:
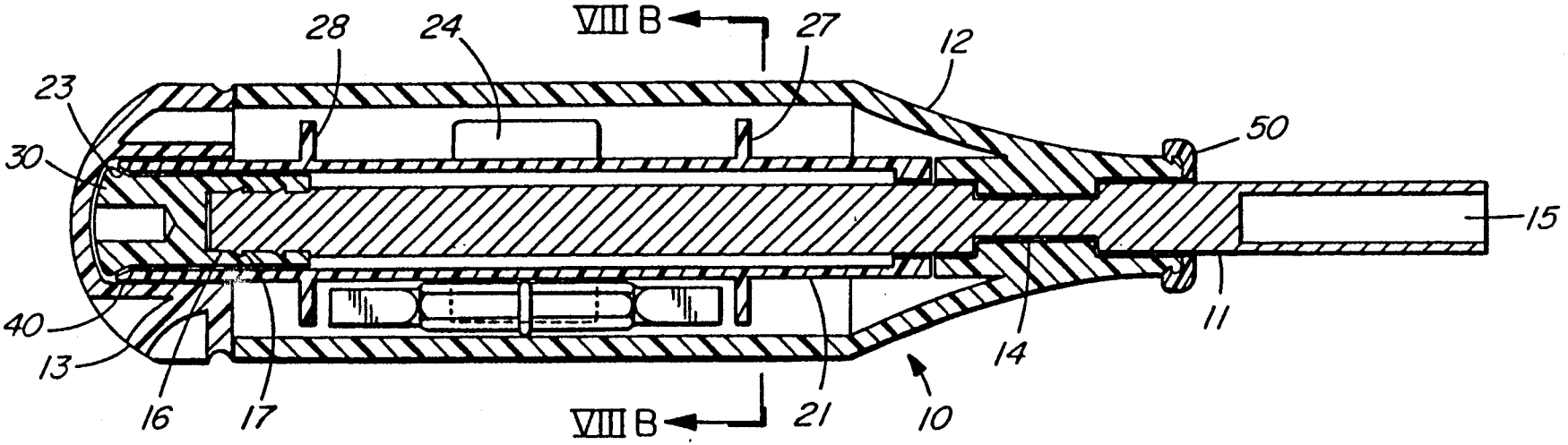
FIG. 8A is a cross-section taken along VIIIA—VIIIA of FIG. 1.
Figure 8B:
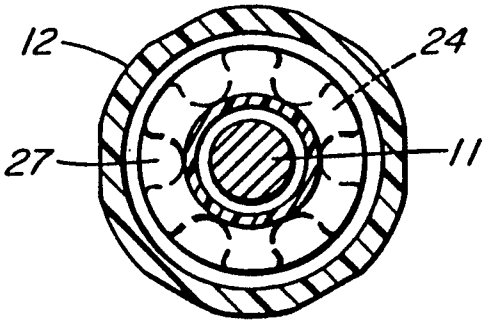
FIG. 8B is a view taken along VIIIB—VIIIB of FIG. 8A.
Figure 9:
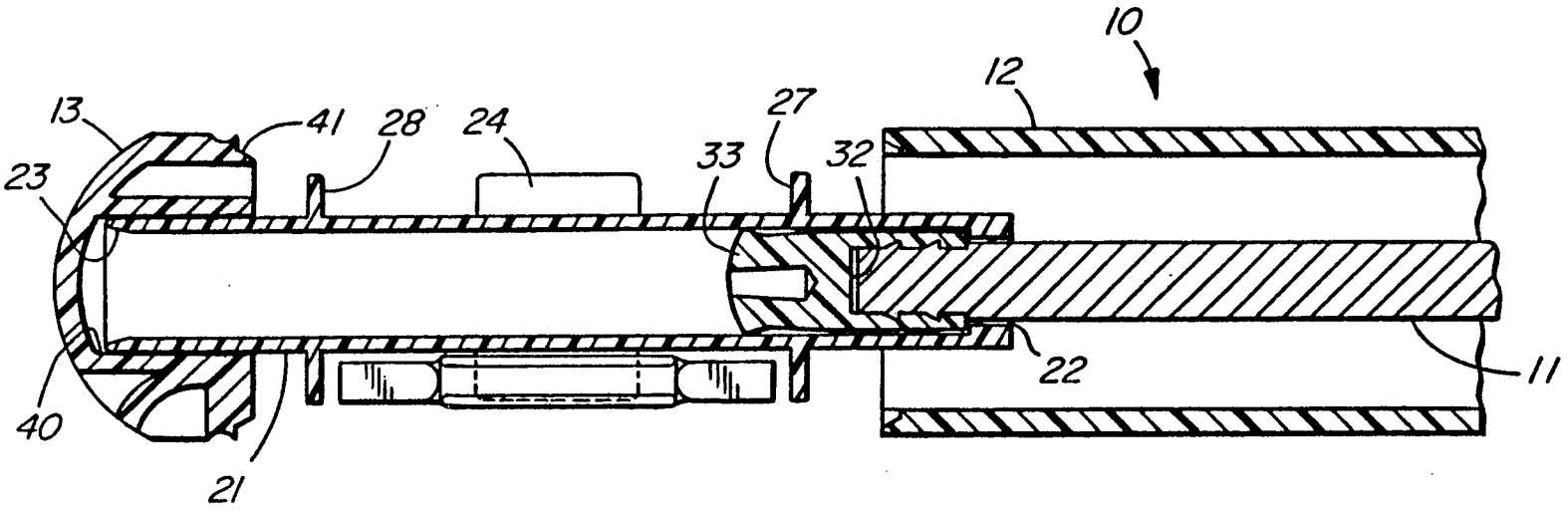
FIG. 9 is a diagrammatic partially cross-sectional view of the screwdriver according to the invention with its handle in its extended position.

End-cap 13 (FIG. 4) includes an opening 40, opening 40 being operable to accept in a press fit the bevel end of the second barrel shaft 21. End-cap 13 also includes a tapered sleeve 41 operable to be inserted into handle 12 to provide positive connection between end-cap 13 and handle 12 and to provide radial support to the handle opening. The taper in sleeve 41 eases entry of end-cap 13 into handle 12 and also facilitates alignment between said end-cap and said handle.

The handle 12 also includes a bearing cap 50 at its anterior end. The bearing cap 50 rotates on and relative to handle 12.

To attach the bit storage magazine 20 (FIG. 5), second barrel shaft 21 is placed over first stationary shaft 11 and the magazine 20 is completely inserted into the hollow handle 12 by sliding along the circumference of the first shaft 11. With the magazine 20 in this fully inserted position within handle 12, the end portion of first stationary shaft 11 is accessible through the end of second barrel shaft 21. Retaining ring 30 is inserted into second barrel shaft 21 such that opening 32 in retaining ring 30 is slipped over the end of first stationary shaft 11 until it is locked in place by the action of the teeth 17.

Magazine 20 is then extracted from hollow handle 12 while retaining ring 30 remains attached to first stationary shaft 11 while, as earlier described, spring clip 33 produces friction against the inside of second barrel shaft 21. The end of second barrel shaft 21 is then inserted into the opening 40 of end-cap 13 and is bonded in place chemically or otherwise. A pocket is thus formed between the second barrel shaft bevel 23 and the end-cap 13 which accepts the expansion of the spring clip 33 in its locked position.

OPERATION

In operation, the magazine 20 is extracted from within the hollow handle 12 by pulling the end-cap 13. The second barrel shaft 21 travels along first stationary shaft 11, guided by the narrow diameter restriction or collar 22 at its anterior end and by the friction caused by spring clip 33. The magazine 20 is extracted until the narrow diameter restriction 22 in second barrel shaft 21 comes into contact with the anterior end of the retaining ring 30.

In the extracted position, the plurality of pairs of fins 24 and their retained tool bits (not illustrated) are fully exposed to the user. The user may inspect the bits and select the desired one by rotating magazine 20 and applying an outward radial force to unclip the bit from the fins 24. A bit no longer needed can be placed between an unused pair of fins 24 by applying an inward radial force.

The magazine 20 is then reinserted into the hollow handle 12 by pushing on end-cap 13. When the magazine 20 is within the handle 12, the spring clip 33 will have travelled into the pocket formed between the second barrel shaft bevel 23 and the end-cap orifice 40 so as to maintain the end-cap 13 in its closed position. The spring clip 33 will expand within the pocket and lock the magazine 20 into the closed position.

A further feature of the invention allows the end-cap 13 to be rotatable about stationary shaft 11 and relative to handle 12 when the magazine 20 is in its closed position. This mechanism allows the user to apply a driving or axial force with one hand and a torque to the tool with the other. To apply the driving force into the workpiece, the user places one hand on the end-cap 13 and applies a force along the axis of the tool. The torque is applied by the user grasping the screwdriver handle 12 and rotating it about the end-cap 13. Alternatively, the bearing 50 may be held and the handle 12 rotated so as to rotate the tool and bit relative to bearing 50.

While a specific embodiment of the invention has been disclosed, many modifications may readily occur to those skilled in the art to which the invention relates. Accordingly, the embodiment should be taken as illustrative of the invention only and not as limiting its scope as defined in accordance with the accompanying claims.

What is claimed is:

1. A multiple bit type tool comprising a chuck, a first shaft extending from said chuck within a handle, a second barrel shaft longitudinally movable on said first shaft from a first position wherein said second barrel shaft is substantially wholly within said handle to a second position wherein said second barrel shaft is substantially outside said handle;

a end-cap mounted on and movable with said second barrel shaft, said end-cap closing the end of said handle when said second barrel shaft is in said first position and opening the end of said handle when said second barrel shaft is in said second position; and a magazine mounted on and movable with said second barrel shaft, said magazine being within said handle when said second barrel shaft is in said first position and outside said handle when said second barrel shaft is in said second position.

2. A tool as in claim 1 wherein said magazine has a plurality of resilient bit holders, said bit holders being mounted about the circumference of said second barrel shaft and being adapted to allow mounting and removal of a plurality of bits.

3. A tool as in claim 1 wherein said end-cap is rotatable relative to said handle when said end-cap is in its closed position.

4. A tool as in claim 3 and further including a bearing rotatable on and relative to said handle.

5. A tool as in claim 1, wherein said magazine is rotatable relative to said handle.

6. A tool as in claim 1 and further comprising means operative between said first shaft and said second barrel shaft for maintaining said end-cap in its closed position and for producing friction during longitudinal movement of said second barrel shaft relative to said first shaft.

7. The tool as in claim 6, wherein said means for maintaining said end-cap in its closed position and for producing friction during said longitudinal movement comprises a resilient clip on said first shaft which is in contact with the inside of said second barrel shaft and including a recess in said second barrel shaft to accommodate said resilient clip when said second barrel shaft is in said first position so as to maintain the end cap in its closed position.

* * * * *